United States Patent [19]

Hammett

[11] Patent Number: 4,700,836

[45] Date of Patent: Oct. 20, 1987

[54] UNIVERSAL CASE FOR TRANSPORTING BOTTLES

[75] Inventor: Roy Hammett, Tampa, Fla.

[73] Assignee: International Container Systems, Inc., Tampa, Fla.

[21] Appl. No.: 908,931

[22] Filed: Sep. 15, 1986

Related U.S. Application Data

[63] Continuation of Ser. No. 761,466, Aug. 1, 1985, abandoned.

[51] Int. Cl.[4] ..... B65D 1/24; B65D 21/02; B65D 71/00; B65D 75/00

[52] U.S. Cl. ..... 206/427; 206/203; 206/503; 220/21

[58] Field of Search ..... 206/161, 201, 203, 427, 206/503, 509, 430

[56] References Cited

U.S. PATENT DOCUMENTS

| | | | |
|---|---|---|---|
| 1,193,980 | 8/1916 | Bowen . | |
| 2,597,407 | 5/1952 | Thompson . | |
| 3,376,998 | 4/1968 | Cornelius | 220/21 |
| 4,040,517 | 8/1977 | Torokvei | 206/203 |
| 4,161,259 | 7/1979 | Palafox | 220/21 |
| 4,162,738 | 7/1979 | Wright | 220/21 |
| 4,344,530 | 8/1982 | de Lorosiere | 206/203 |
| 4,360,231 | 11/1982 | Bolin | 206/430 |
| 4,373,627 | 2/1983 | Wood | 206/203 |
| 4,548,320 | 11/1985 | Box | 206/427 |

FOREIGN PATENT DOCUMENTS

| | | | |
|---|---|---|---|
| 99827 | 3/1984 | European Pat. Off. | 206/203 |
| 3226950 | 5/1983 | Fed. Rep. of Germany | 206/427 |

*Primary Examiner*—George E. Lowrance
*Attorney, Agent, or Firm*—Pennie & Edmonds

[57] ABSTRACT

A universal case capable of transporting PET bottles of a base-cup type and a petaloid type includes an outer shell 4, 6 and a plurality of support ribs 32, 34, 36, 38 which are shaped to define a plurality of bottle pockets 25 for receiving the bases of PET bottles. A bottle seating structure 40 associated with each bottle pocket 25 includes a base-cup-bottle alignment structure 42, 44, 48 and a petaloid-bottle alignment structure 54, 56. The two alignment structures 42, 44, 48, 54, 56 are adapted to orient PET bottles respectively of the base cup type and the petaloid type seated in the bottle pocket 25 so that the longitudinal symmetry axis of the bottles extend generally parallel to the pocket centerline. The case also includes a case rest 60 associated with each bottle pocket 25. The case rest 60 has a central-base-surface bottle-to-case load-transmission surface 61 facing the bottle pocket 25 and a case-to-closure load-transmission surface 63 facing outward from the bottom of the case. Contact surfaces of the base-cup-bottle alignment structure and the petaloid-bottle alignment structure are offset from one another so that the central base surface bottle-to-case load-transmission surface 61 of the case rest 60 is positioned to contact a central base surface 108, 130 of bottles 100, 120 of both the base-cup type and the petaloid type when the bottles are seated in the bottle seating structure 40.

9 Claims, 7 Drawing Figures

UNIVERSAL CASE FOR TRANSPORTING BOTTLES

This is a continuation of application Ser. No. 761,466, filed Aug. 1, 1985, now abandoned.

TECHNICAL FIELD

The present invention relates to a reusable plastic case for transporting bottles of beverage and the like.

BACKGROUND ART

It has become increasingly common for soft drinks and other beverages to be sold in bottles made of plastic. Bottles made of the plastic polyethylene terephthalate (PET) have become particularly popular with the soft-drink industry because of their transparency, light weight and low cost. Typically, such bottles are of a one-liter, two-liter, three-liter, or four-liter capacity.

Two types of PET bottles are generally used by soft drink bottlers today: a base-cup type and a petaloid type. Both types of PET bottles are generally symmetric in shape having a longitudinal symmetry axis.

Conventional PET bottles of the base-cup type have three parts: a vessel made of PET plastic for containing the beverage, a closure for sealing the vessel, and a base cup. The base portion of the PET vessel is generally hemispherical in shape and thus does not provide a surface on which the bottle can stand upright. The base cup is a separately formed piece which is attached to the base of the PET vessel and has a bottom which is shaped to permit the bottle to stand upright on a flat horizontal surface.

Conventional PET bottles of the petaloid type have only two parts: a petaloid vessel made of PET plastic and a closure for sealing the vessel. Typically, the base portion of the PET petaloid vessel has six petaloid lobes projecting from it in a generally circular arrangement. Bottom surfaces of the lobes are generally substantially coplanar with respect to one another and permit the bottle to stand upright on a horizontal flat surface.

Although the walls of PET bottles are flexible, they are strong in tension and thus can safely contain the pressure of carbonated beverages. Moreover, conventional PET bottles of either the base-cup or the petaloid type can bear surprisingly high compressive loads if the load is directed substantially along the longitudinal symmetry axis of the bottle. A single PET bottle can support the weight of many bottles of the same size filled with beverage if the bottle in question is standing upright and the weight of the other bottles is applied to the closure of the single bottle and directed substantially vertically along the symmetry axis. However, if a compressive load is applied to a conventional PET bottle along a direction other than the symmetry axis of the bottle, the bottle tends to buckle and give way.

U.S. Pat. No. 4,344,530 of deLarosiere (the '530 patent) discloses a molded plastic case for PET bottles. The case has bottle pockets which are shaped to fit closely the bases of bottles inserted in the pockets and so to orient the bottles along the centerlines of the pockets. Thus, bottles seated in the pockets are oriented so that the weight of a stack of cases of bottles filled with beverage is properly transmitted along the longitudinal symmetry axes of the bottles. The '530 patent refers specifically only to PET bottles of the base-cup type, although teachings of the patent are applicable to PET bottles of the petaloid type as well. The specific cases exemplified in the '530 patent are only suitable for transporting PET bottles of the base-cup type.

A commercial soft-drink bottling operation typically requires a "float" of tens of thousands of cases to warehouse PET bottles of soft drinks and to deliver the bottles to retail stores. A need exists for a reusable case which permits stable stacking of the cases of PET bottles of both the base-cup type and the petaloid type, so that a soft-drink bottler can switch from one type of PET bottle to the other as market conditions dictate without having to replace the float of cases used to warehouse and deliver the bottles.

DISCLOSURE OF THE INVENTION

I have invented a reusable plastic case for PET bottles of both the base-cup type and the petaloid type which permits stable stacking of cases of bottles either type and which avoids problems of the prior art noted above.

Conventional PET bottles of both the base-cup type and the petaloid type are generally symmetrical in shape with a longitudinal symmetry axis. The bottles have a closure for sealing the bottle which is generally centered with respect to the symmetry axis.

Conventional PET bottles of the base-cup type have a base cup with an underside which is shaped to permit the bottle to stand upright on a flat horizontal surface. The underside of a conventional base cup has two generally concentric surfaces which are approximately coplanar with respect to one another: a base-cup-bottle central base surface and a generally annular bottom surface. Both the base-cup-bottle central base surface and the annular bottom surface are substantially centered with respect to the symmetry axis of the bottle. The annular bottom surface of the base cup is positioned to contact a surface on which the bottle stands.

Conventional PET bottles of the petaloid type have six petaloid lobes formed in the base of the bottle which permit the bottle to stand upright on a flat horizontal surface. The six lobes are disposed symmetrically in a circular arrangement about the longitudinal symmetry axis of the bottle. The petaloid lobes have underside surfaces which are substantially coplanar with respect to one another to form lobe bottom surfaces for contacting the surface on which the bottle stands. The lobe bottom surfaces define a petaloid-bottle support plane. A region located in a base portion of the petaloid bottle generally radially inwardly of the petaloid lobes defines a petaloid-bottle central base surface. The petaloid-bottle central base surface is offset from the petaloid-bottle support plane by a petaloid-bottle central-base-surface clearance distance.

The case of the invention is molded from a plastic material such as high-impact polyethylene. The case comprises an outer shell such as a top sheet and rectangular side wall. The case further comprises a plurality of support elements which are connected to and generally disposed within the outer shell. The support elements tend to reinforce the outer shell. The outer shell and support elements are shaped to define a plurality of bottle pockets for receiving the bases of PET bottles. Preferably, the case includes six bottle pockets arranged in two parallel rows with three pockets in each row. Alternatively, the case could include eight bottle pockets arranged in two parallel rows with four pockets in each row. Other numbers and arrangements of bottle pockets may be used if desired. A pocket centerline is defined to extend generally centrally through each bottle pocket.

The case of the invention also includes a bottle seating structure associated with each of the bottle pockets for seating bottles inserted into the pockets. Each bottle seating structure is connected to the outer shell of the case or to one or more of the support elements. The bottle seating structure includes a base-cup-bottle alignment structure and a petaloid-bottle alignment structure.

The base-cup-bottle alignment structure is adapted to orient a PET bottle of the base-cup type seated in the bottle pocket so that the symmetry axis of the bottle extends generally parallel to the pocket centerline. The base-cup-bottle alignment structure has a base-cup-bottle annular-bottom-surface contact surface which is oriented generally normal to the pocket centerline and disposed to contact the annular bottom surface of the base cup of the PET bottle seated in the pocket to orient the bottle. The base-cup-bottle annular-bottom-surface contact surface defines a base-cup-bottle annular-bottom-surface contact plane.

The petaloid-bottle alignment structure is adapted to orient a PET bottle of the petaloid type seated in the bottle pocket so that the symmetry axis of the bottle extends generally parallel to the pocket centerline. The petaloid-bottle alignment structure has six petaloid-bottle lobe-bottom-surface contact surfaces. The lobe-bottom-surface contact surfaces of the bottle seating structure are approximately coplanar with respect to one another to define a petaloid-bottle lobe-bottom-surface contact plane which is oriented generally normal to the pocket centerline. The six petaloid-bottle lobe-bottom-surface contact surfaces are disposed in a generally circular arrangement about the pocket centerline at locations to register with and contact the lobe bottom surfaces of the bottle seated in the bottle pocket to orient the bottle.

When a case of the invention is in a horizontal rest position, the petaloid-bottle lobe-bottom-surface contact plane lies below the base-cup-bottle annular-bottom-surface contact plane by a distance which approximately equals the petaloid-bottle central-base-surface clearance distance.

The case of the invention further includes a plurality of case rests, each of which is associated with a bottle pocket. Each case rest is connected to the bottle seating structure associated with the bottle pocket. Each case rest is generally symmetrically located with respect to the pocket centerline of the bottle pocket and has two case-rest load-transmission surfaces: a central-base-surface bottle-to-case load-transmission surface and a case-to-closure load-transmission surface. The central-base-surface bottle-to-case load-transmission surface and the case-to-closure load-transmission surface face in generally opposite directions with the central-base-surface bottle-to-case load-transmission surface facing the interior of the bottle pocket. The two load-transmission surfaces are spaced apart from one another in a direction generally parallel to the centerline. The central-base-surface bottle-to-case load-transmission surface is located approximately in the base-cup contact plane in a position to contact the central base surface of PET bottles of both the base-cup and the petaloid type. The case rest is generally flared in shape or otherwise configured to locate a closure of a bottle oriented generally coaxially with the pocket centerline centrally within the case rest with the top of the closure in contact with the case-to-closure load-transmission surface.

Cases of the invention loaded with bottles can be stacked one on top of the other with the case rests of an upper case resting on the closures of bottles of one or more lower cases immediately below with the case-to-closure load-transmission surfaces of the case rests of the upper case contacting the tops of the closures of the bottles of the lower cases. For PET bottles of both the base-cup type and the petaloid type, the central base surfaces of the bottles in the upper case contact the central-base-surface bottle-to-case load-transmission surfaces of the case rests. Weight can thereby be transmitted substantially directly compressively from the central base surfaces of the bottles in the upper case to the tops of the closures of bottles in the next lower case through the case rests of the upper case.

A base plane for the case of the invention can be defined generally parallel to the top sheet of the case and located a distance from the top sheet which defines a case height distance. The base-cup-bottle alignment structure of the bottle seating structure preferably has a base-cup-bottle annular-bottom-surface case-to-floor load-transmission surface located substantially in the base plane of the case and generally opposing the base-cup-bottle annular-bottom-surface contact surface. When such a preferred case is in a lowermost tier of a multitiered stack of cases resting on a horizontal flat surface such as a warehouse pallet and loaded with PET bottles of the base-cup type, weight loads from the annular bottom surfaces of the base cups of bottles in the case tend to be substantially directly compressively transmitted to the surface on which the case is resting by means of the base-cup-bottle alignment structure.

The petaloid-bottle alignment structure preferably has a plurality of petaloid-bottle lobe-bottom-surface case-to-floor load-transmission surfaces, each of which is located substantially in the base plane of the case and generally opposing a corresponding the lobe-bottom-surface contact surface of the petaloid-bottle alignment structure. When such a preferred case is in a lowermost tier of a multitiered stack of cases and loaded with PET bottles of the petaloid type and resting on a horizontal flat surface, weight loads from the petaloid lobes of the bottles in the case tend to be substantially directly compressively transmitted to the surface on which the case is resting by means of the petaloid-bottle alignment structure.

Thus, for PET bottles of both the base-cup type and the petaloid type, preferred cases of the invention provide for the substantially direct compressive transmission of weight loads through the plastic material of the cases within a multitiered stack of cases filled with bottles. For any given tier above the lowermost tier in such a stack, weight loads are substantially directly compressively transmitted from the central base surfaces of the bottles to the tops of closures of bottles in cases immediately below. For the lowermost tier in such a stack, weight loads are substantially directly compressively transmitted to the floor on which the stack is resting from the annual bottom surfaces of the base cups of bottles of the base-cup type or from the lobe bottom surfaces of bottles of the petaloid type. Depending on the type of bottle in the case and the location of the case in a stack, cases of the invention tend to yield slightly to shift weight loads so that the loads are substantially directly compressively transmitted.

Soft-drink bottlers typically warehouse cases of soft drinks stacked on pallets, with five layers of cases to a pallet and with one pallet of cases stacked on top of another. The weight loads which must be borne by the lower tiers of such a ten-tiered structure are enormous. By substantially directly compressively transmitting weight loads from the central base surfaces of the PET bottles in one tier of a stack to the closures of corresponding bottles in the next lower tier, the elements of the case of the invention transmitting the loads can be made relatively thin and yielding in flexure in the dimension across which the load is transmitted. Similarily, with respect to PET bottles of the petaloid type in a lowermost tier of a stack, by substantially directly compressively transmitting weight loads from the lobe bottom surfaces of the bottles to the floor on which the stack is resting, the elements of preferred cases of the invention transmitting such loads to the floor can be made relatively thin and yielding in flexure in the dimension across which the load is transmitted. With respect to PET bottles of the base-cup type in a lowermost tier of a stack, although weight loads are substantially directly compressively transmitted to the floor from the annular bottom surfaces of the base cups of the bottles in preferred cases of the invention, elements of such cases transmitting the loads generally must be thick enough to account for the petaloid-bottle central-base-surface clearance distance between the central base surface and the bottle support plane of petaloid PET bottles. Because certain load transmission elements can be relatively thin and yielding in flexure, preferred cases of the invention can be light in weight and inexpensive to manufacture even though such cases can be used to construct stacks of bottles of beverage which weigh thousands of kilograms.

The case of the invention may be used to advantage with conventional PET bottles of any capacity, including one-liter, two-liter, three-liter, or four-liter PET bottles. The case is particularly advantageous for use with three-liter or four-liter PET bottles.

Preferably, the height of a case of the invention is no greater than about one half the height of the bottles to be transported in the case. For example, a preferred case of the invention may have a height equal to about one third the height of the bottles to be transported in the case. A particularly preferred case of the invention for use with six conventional three-liter PET bottles is about 10 centimeters high, about 28 centimeters wide and about 42 centimeters long. Conventional three-liter PET bottles are about 33 cm high.

The low profile of preferred cases of the invention permits the labels of bottles seated in the case to be visible. Thus such cases are suitable for displaying bottled beverages to consumers in a retail store. The material of which the case is made is preferably brightly colored to enhance the attractiveness of such a display. A brand name or logo can be imprinted on the side walls of the case if desired.

Preferably, each bottle pocket of a case of the invention is equipped with a bottle side-wall gripper adapted to grip the side wall of bottles inserted in the bottle pocket to assist in orienting the bottle so that the longitudinal axis of the bottle substantially coincides with the centerline of the pocket.

The petaloid bottle alignment structure is preferable shaped to guide and locate the lobes of petaloid bottles inserted in a bottle pocket so that the lobe bottom surfaces of the bottle tend to be brought into registry with the lobe-bottom surface contact surfaces of the alignment structure.

Preferred cases of the invention filled with PET bottles of either the base-cup type or the petaloid type can be arranged in column-stacked and cross-stacked multi-tiered structures.

Preferably, the support elements, bottle seating structures and case rests adjacent to the base plane of a case of the invention form an open network structure. Such an open network structure minimizes the material required to manufacture the case and thus minimizes the cost of the case. In addition, an open network structure at the base of the case facilitates the cleaning of the case. The lower edges of the side walls of the case are preferably offset from the base plane of the case. Thus when such a preferred case of the invention is resting on a flat horizontal surface, there is a clearance gap between the surface on which the case is resting and the side walls of the case. The clearance gap reduces the possibility that spilled beverage or other liquid will be trapped in the case and provides drainage after the case is washed.

Preferably, each case rest of a case of the invention has an opening passing centrally through it. The diameter of the opening is less than an outside diameter of the top of the closure of bottles the case is to carry. The openings in the case rests prevent trade names and logos printed on the central portion of the tops of the closures from being worn off by abrasion from a case resting on the closures. In addition, the seals of certain types of closures of PET bottles can become broken if the closure is deformed by a load applied to the center of the top of the closure. This problem is particularly acute for closures made of plastic and can result in the loss of carbonation of the beverage in the bottle. Preferred case rests of the invention, by having an opening passing through the center of the case rest, tend to bear against annular peripheral areas of the tops of closures and thus tend to reinforce the seal of the closures.

Preferred cases of the invention can be molded as a unitary structure from a plastic material such as high impact polyethylene. Such cases are economical to produce.

With a float of cases of the invention, a soft drink bottler can store and transport PET bottles of either the base-cup type or the petaloid type. The bottler is free to change from one type of bottle to the other without having to replace the cases used to store and transport the bottles.

BRIEF DESCRIPTION OF THE DRAWINGS

Preferred embodiments of the invention are described below with reference to the following drawings.

BEST MODE FOR CARRYING OUT THE INVENTION

Figure 1:
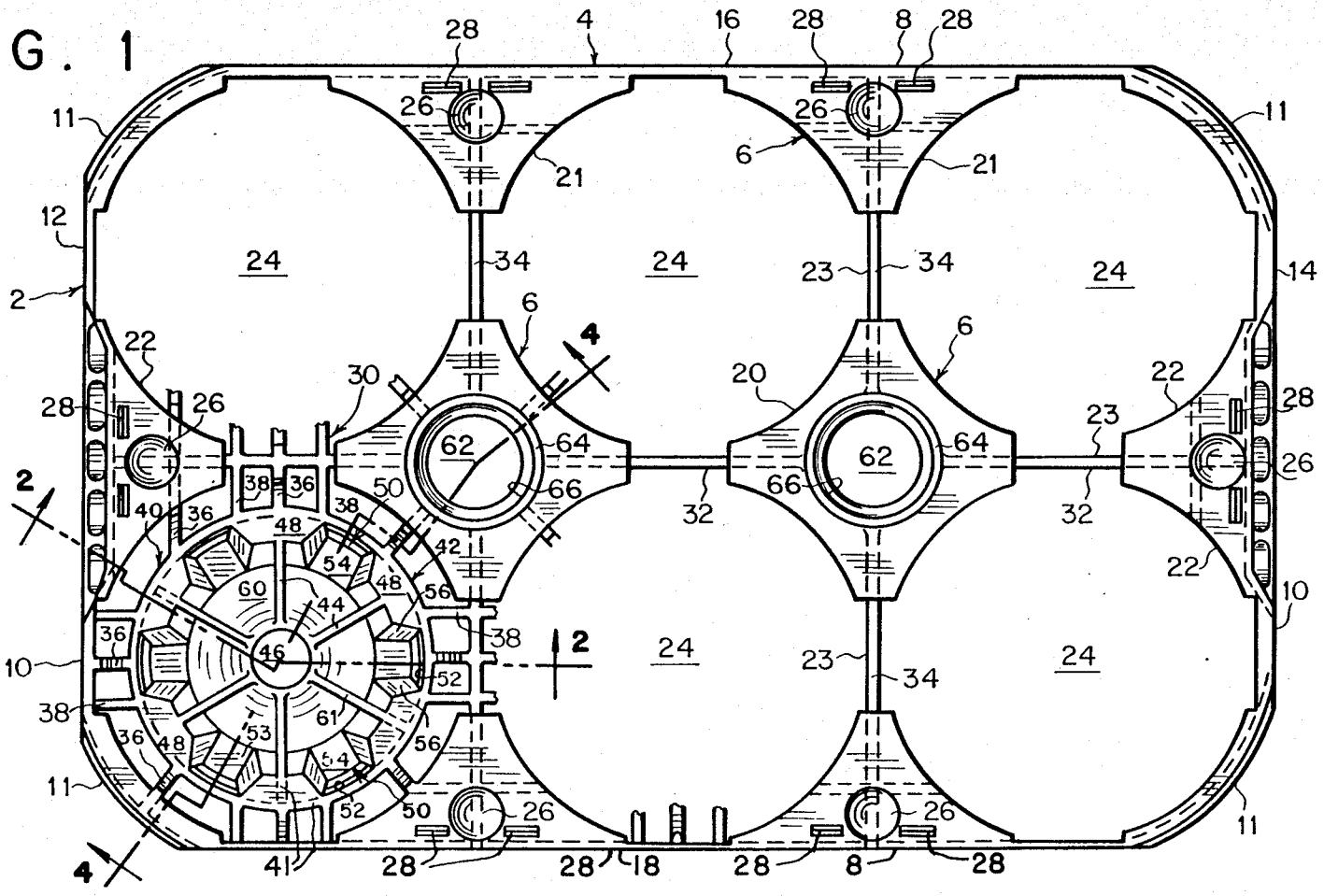
FIG. 1 is a top view of a preferred case of the invention for containing six PET beverage bottles.

Referring now to FIG. 1, a case 2 has a side wall 4 and a top sheet 6. The side wall 4 includes two opposing lengthwise wall sections 8 and two opposing crosswise wall sections 10. The lengthwise and crosswise wall sections join at generally rounded corners 11. Each lengthwise wall section 8 has a central area (not shown) which is slightly indented. A brand name or logo can be imprinted in the indented area, where it is protected against abrasion.

The top sheet 6 is generally rectangular in shape, having a first and a second crosswise edge 12 and 14 and a first and a second lengthwise edge 16 and 18. The ratio of the distance between the first and the second crosswise edges 12 and 14 to the distance between the first and the second lengthwise edges 16 and 18 is approximately equal to 3/2. The top sheet 6 is made up of two central top-sheet elements 20, four lengthwise edge top-sheet elements 21, two crosswise-edge top-sheet elements 22 and rib top elements 23 which interconnect the central top-sheet elements 20 and the edge top-sheet elements 21 and 22.

Six pocket openings 24 pass through the top sheet 6. The location of the pocket openings 24 and other features of the top sheet 6 are conveniently understood in terms of a face-centered square lattice of points (not shown) defined to be coplanar with the top sheet 6. The face-centered square lattice is made up of corner vertices defined by the points of intersection of a square grid and center vertices defined by the centers of the squares of the grid. The length of the sides of the squares of the grid is approximately equal to one-half the distance between the two lengthwise edges of the top sheet 6. In order to understand the relative positioning of cases of bottles in the tiers of a cross-stacked structure, it is convenient to think of the lattice as extending indefinitely in a plane. The lattice is oriented with respect to the top sheet 6 so that mutually perpendicular sides of the squares of the grid are respectively parallel to the crosswise edges 12 and 14 and the lengthwise edges 16 and 18 of the top sheet 6. Two adjacent squares of the grid are singled out to define a first and a second lattice square. The lattice is positioned to locate the first and the second lattice squares symmetrically within the boundaries of the top sheet 6. In particular, the lattice is positioned so that the two corner vertices shared by the first and the second lattice squares fall on a crosswise midline of the top sheet 6, and so that a lengthwise midline of the top sheet 6 substantially bisects the first and the second lattice squares. Six pocket centerlines are defined by lines normal to the top sheet 6 and passing respectively through the six corner vertices of the first and the second lattice squares. The six pocket openings 24 in the top sheet 6 are generally circular in shape and are positioned substantialy concentrically with respect to the six pocket centerlines.

In each of the lengthwise-edge and crosswise-edge top-sheet elements 21 and 22 a thumb-grip depression 26 is formed. Proximate to the thumb-grip depression 26 are two thumb-grip tabs 28. The thumb-grip tabs 28 project above the surface of the top sheet 6 and cooperate with the thumb-grip depressions 26 to facilitate a user's gripping the case by hand. In addition, the thumb-grip tabs 28 located on the four lengthwise-edge top-sheet elements 21 assist in stacking empty cases by engaging the lower edges of the lengthwise wall sections of an upper case stacked on an empty lower case.

Figure 3:
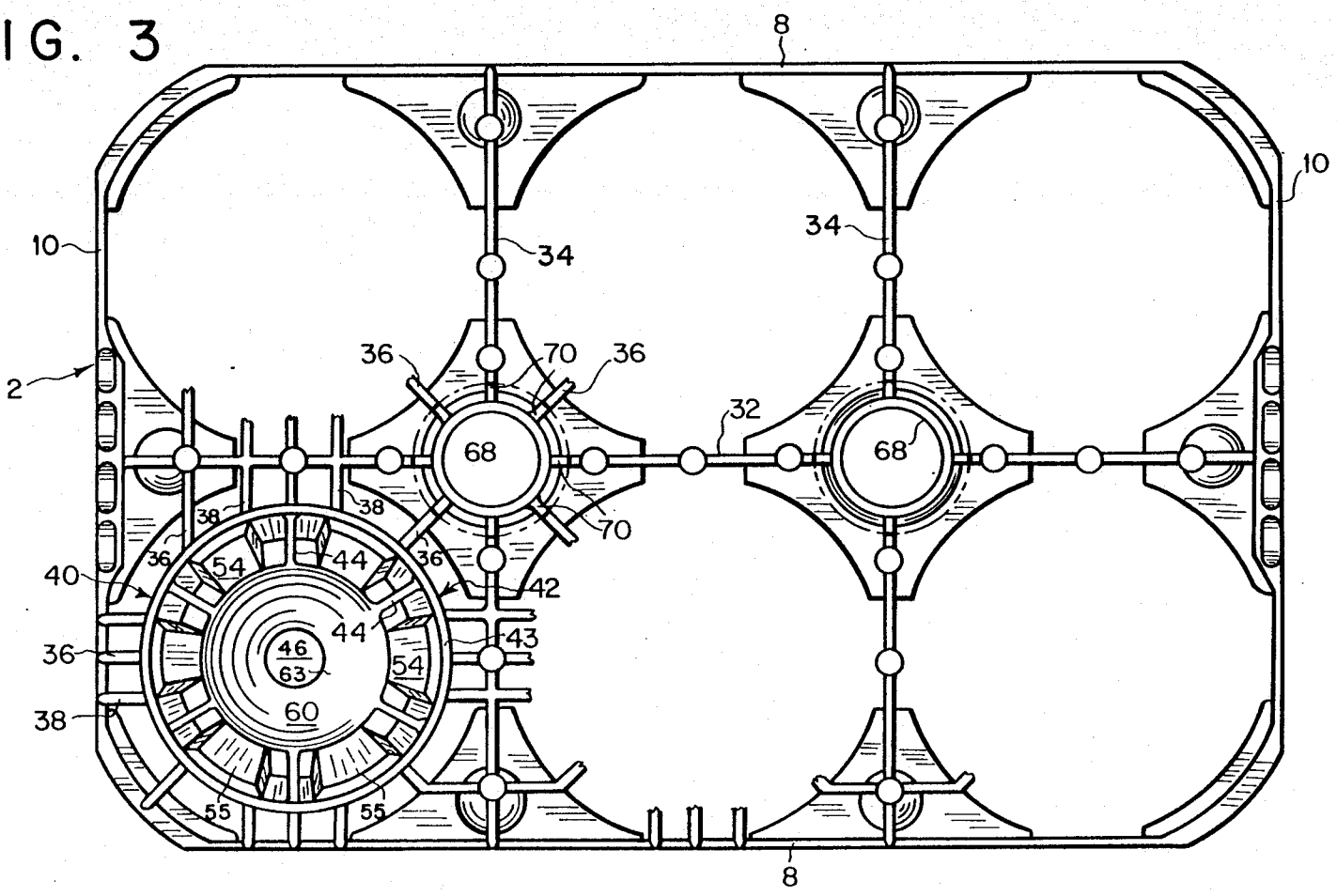
FIG. 3 is a bottom view of the case of FIG. 1.

The case 2 includes a network of support elements 30 to reinforce the case and support the bottles. The support elements 30 are molded integrally with the case 2 and are tapered slightly (not shown) in order to facilitate removing the case from the mold. The support elements 30 include a lengthwise partition rib 32, two crosswise partition ribs 34, contour ribs 36 and base ribs 38. As shown best in FIG. 4, the contour ribs 36 are shaped to follow closely the contour of the base of a PET bottle of the base-cup type. Eight contour ribs 36 are associated with each pocket opening 24. Turning again to FIG. 1, a bottle seating structure 40 is connected to the contour ribs 36 and the base ribs 38 associated with each pocket opening 24. For simplicity, only one of six bottle seating structures 40 is shown in FIGS. 1 and 3. Each bottle seating structure 40 and the eight contour ribs 36 connected to it define a pocket well. Each pocket well and adjacent pocket opening 24 define a bottle pocket 25.

The bottle seating structure 40 includes a base-cup contact ring 42. The base-cup contact ring 42 is substantially centered with respect to the center line of the bottle pocket 25. As explained in more detail in connection with FIG. 2A below, the base-cup contact ring 42 is dimensioned so that it has an outside diameter which is approximately equal to the outside diameter of the annular bottom surface of the base cup of a PET bottle of the base cup type. Six beveled lobe-clearance notches 52 are formed in the base-cup contact ring 42 to permit the ring to pass radially outwardly of the lower portions of the petaloid lobes of the base of a PET bottle of the petaloid type. A top edge of the base-cup contact ring 42 defines a base-cup-bottle annular-bottom-surface contact plane oriented substantially normal to the pocket centerline.

Figure 4:
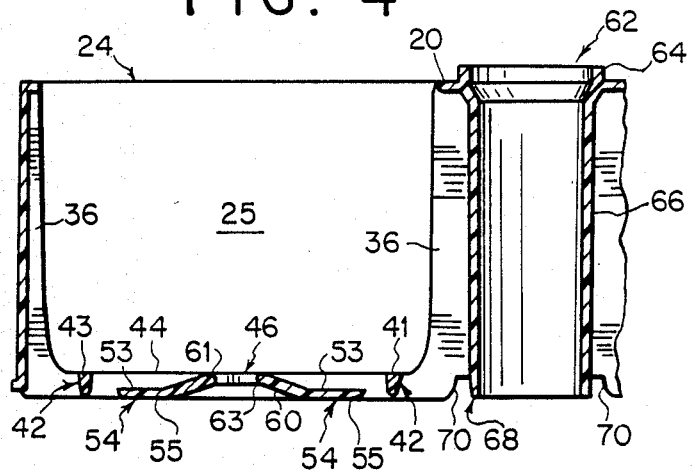
FIG. 4 is a partial cross-sectional view of the case of FIG. 1 taken along line 4—4 of FIG. 1.

As shown in FIG. 4 lowermost edges of the support elements 30 of the case 2 are generally coplanar with respect to one another and define a base plane on which the case 2 rests when it is placed on a horizontal flat surface. A lower edge of the base-cup contact ring 42 is substantially coplanar with the base plane.

Turning again to FIG. 1, six base-cup contact spokes 44 are joined to the base-cup contact ring 42 and extend radially inwardly from the contact ring 42 toward the centerline of the bottle pocket 25. A top edge of each base-cup contact spoke 44 is approximately coplanar with the base-cup-bottle annular-bottom-surface contact plane. A base-cup contact platform 48 extends on either side of each base-cup contact spoke 44 in the vicinity of the junction between the spoke and the base-cup contact ring 42.

Located between each pair of adjacent base-cup contact spokes 44 is a petaloid-lobe receptacle 50. The petaloid-lobe receptacles 50 extend below the base-cup-bottle annular-bottom-surface contact plane when the case 2 is in a horizontal rest position. A radially outer perimeter of each receptacle 50 is defined by the corresponding lobe-clearance notch 52 in the base-cup contact ring 42. A petaloid-lobe contact strip 54 extends in a generally radial direction along a bottom of each petaloid-lobe receptacle 50. The surfaces of the six petaloid-lobe contact strips 54 facing the bottle pocket 25 are approximately coplanar with respect to one another and define a petaloid-bottle lobe-bottom-surface contact plane substantially normal to the pocket centerline. Each of two azimuthally opposing sides of each petaloid-lobe contact strip 54 is connected to a base-cup contact platform 48 by an inclined lobe-locating sidewall 56. The two inclined lobe-locating sidewalls 56 connected to each petaloid-lobe contact strip 54 tend to locate the bottoms of the petaloid lobes of a PET bottle of the petaloid type inserted in the bottle pocket 25.

As shown in FIG. 4, a case rest 60 is connected to a radially inner edge of each petaloid-lobe contact strip 54 and to radially inner portions of each base-cup contact spoke 44. The case rest 60 is generally flared in shape and extends from the petaloid-bottle lobe-bottom-surface contact plane at a radially outer perimeter to the base-cup-bottle annular-bottom-surface contact plane at a radially inner perimeter. A pocket center opening 46 passes through the center of the case rest 60. A central-base-surface bottle-to-case load-transmission surface 61 of the case rest 60 is defined by a perimeter strip around the pocket center opening 46 on the case rest 60 facing the bottle pocket 25 together with edges of radially-innermost extensions of the base-cup contact spokes 44 facing the bottle pocket 25. A perimeter strip around the pocket center opening 46 on the side of the case rest 60 facing away from the bottle pocket 25 defines a case-to-closure load-transmission surface 63.

Figure 2A:
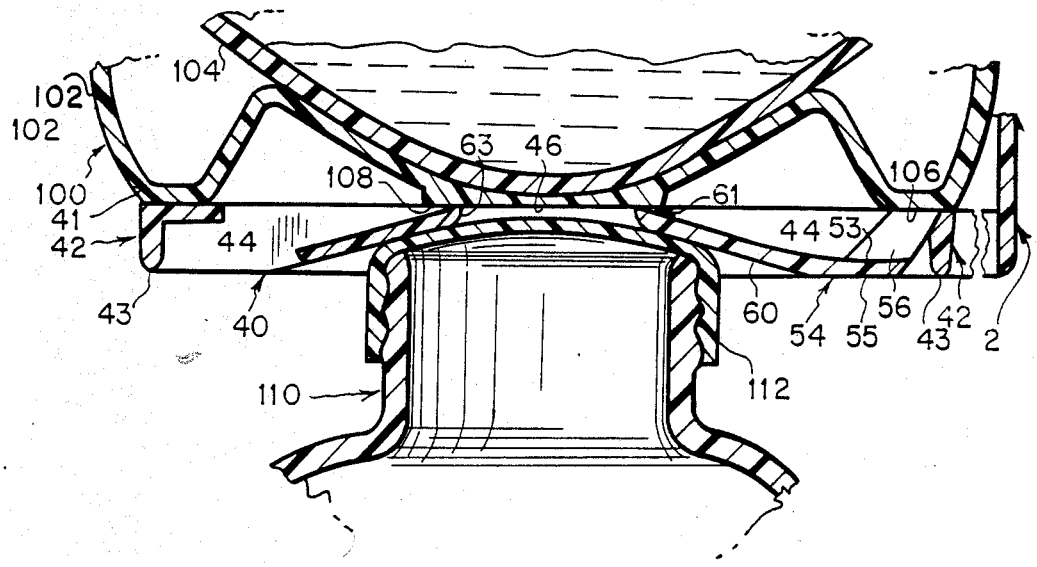
FIG. 2A is a partial cross-sectional view taken along line 2—2 of FIG. 1 illustrating a lower portion of a bottle pocket of the case of FIG. 1 holding a PET bottle of the base-cup type and resting on the closure of a bottle.

Turning now to FIG. 2A, the bottle seating structure 40 of the case 2 is located between a lower portion of a first PET bottle 100 of the base-cup type and an upper portion of a second PET bottle 110. Such an arrangement would result if the case 2 were incorporated in any but the lowest tier of a multitiered stack of cases loaded with PET bottles of the base-cup type.

The PET bottle 100 has a base cup 102 which is attached to a hemispherical base portion of a PET vessel 104 of the bottle. The base cup 102 is generally axially symmetric in shape with an underside formed to permit the bottle to stand upright on a horizontal flat surface. An annular bottom surface 106 is formed on the underside of the base cup 102 and defines a base-cup bottle support plane. A base-cup-bottle central base surface 108 is located centrally of the annular bottom surface 106 approximately in the base-cup bottle support plane.

An outside diameter of the annular bottom surface 106 is approximately the same as the outside diameter of the base-cup contact ring 42 of the base cup 102. The base-cup contact ring 42 and the base-cup contact spokes 44 tend to orient the PET bottle 100 in a direction normal to the base-cup annular-bottom-surface contact plane so that the longitudinal symmetry axis of the bottle tends to extend generally parallel to the centerline of the bottle pocket.

A base-cup-bottle annular-bottom-surface bottle-to-case load-transmission surface 41 is defined by a top edge of the base-cup contact ring 42 together with top edges of the base-cup contact spokes 44 extending from the contact ring 42 radially inward to a radius corresponding to an inside radius of the annular bottom surface 106. The base-cup-bottle annular-bottom-surface bottle-to-case load-transmission surface 41 contacts the annular bottom surface 106 of the base cup 102 when the PET bottle 100 is seated in the bottle pocket 25. A base-cup-bottle annular-bottom-surface case-to-floor load-transmission surface 43 is defined by the lower edge of the base-cup contact ring 42 together with lower edges of the base-cup contact spokes 44 extending from the contact ring 42 radially inward to a radius corresponding to the inside radius of the annular bottom surface 106 of the base cup 102. The base-cup-bottle annular-bottom-surface case-to-floor load-transmission surface is substantially coplanar with the base plane of the case.

In a multitiered stack of cases filled with PET bottles of the base-cup type, the weight load is borne by a case principally in one of two ways, depending on whether the case is in the lowermost tier or in one of the higher tiers. FIG. 2A illustrates how a case in a tier above the lowermost tier bears a weight load and transmits it to the next lower tier. Specifically, the case 2 permits a weight load to be transmitted substantially directly compressively from the base-cup bottle central base surface 108 of the base cup 102 of the bottle 100 seated in the bottle pocket to the top of a closure 112 of the second PET bottle 110.

The second PET bottle 110 extends below the case 2 and is oriented substantially coaxially with the centerline of the bottle pocket associated with the bottle seating structure 40. The closure 112 secured to the second PET bottle 110 is located centrally within the case rest 60 in contact with a lower surface of the case rest. Under load in a stack of cases, the base-cup-bottle central base surface 108 of the bottle 100 tends to bear against the central-base-surface bottle-to-case load-transmission surface 61 of the case rest 60. The case-to-closure load-transmission surface 63 in turn tends to bear against an annular rim area of the top of the closure 112. The pocket center opening 46 protects trade names and logos printed on the central portion of the top of the closure 112 from abrasion by the case resting on the closure. Thus when a case 2 loaded with PET bottles of the base-cup type is incorporated in a stack of such cases on any but the lowermost tier of cases, a portion of the weight borne by the case tends to be substantially directly compressively transmitted from the central base surfaces 108 of the PET bottles 100 in the case to the annular rim areas of the tops of the closures 112 of the bottles 110 in the cases just below.

When the case 2 is incorporated in the lowermost tier of a stack of cases filled with PET bottles of the base-cup type and is resting on a flat surface such as a warehouse pallet (not shown), a portion of the load borne by the case tends to be substantially directly compressively transmitted from the annular bottom surface 106 of the base cup 102 of the bottle to the surface on which the case is resting by way of the base-cup contact ring 42 and radially-outer portions of the base-cup contact spokes 44. Under load in the lowermost tier of cases, the annular bottom surface 106 of the base cup 102 tends to bear against the base-cup-bottle annular-bottom-surface bottle-to-case load-transmission surface 41 of the base-cup contact spokes 44 and the base-cup contact ring 42. The base-cup-bottle annular-bottom-surface case-to-floor load-transmission surface 43 in turn tends to bear against the floor on which the case is resting. Thus when a case 2 filled with PET bottles of the base-cup type is incorporated in the lowermost tier of a multitiered stack of such cases, a portion of the weight borne by the case tends to be substantially directly compressively transmitted from the annular bottom surface 106 of the base cups 102 of the PET bottles to the surface on which the case is resting.

Figure 2B:
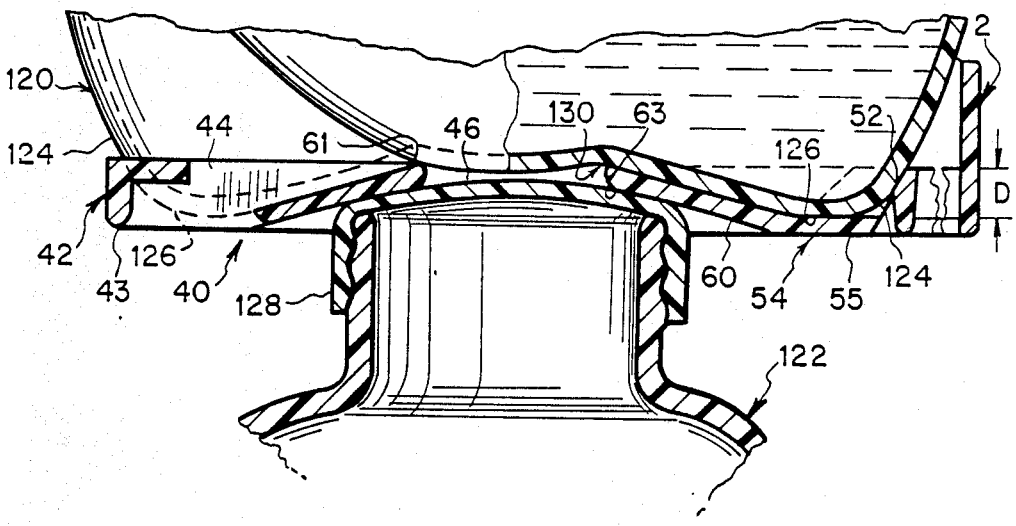
FIG. 2B is a partial cross-sectional view taken along line 2—2 of FIG. 1 illustrating a lower portion of a bottle pocket of the case of FIG. 1 holding a PET bottle of the petaloid type and resting on a closure of a bottle.

Turning now to FIG. 2B, the bottle seating structure 40 of the case 2 is located between a lower portion of a first PET bottle 120 of the petaloid type and an upper portion of a second PET bottle 122, as would result if the case 2 were incorporated in any but the lowermost tier of a multitiered stack of such cases loaded with PET bottles of the petaloid type.

The first PET bottle 120 has six petaloid lobes 124 projecting from the base of the bottle. Only two of the petaloid lobes 124 are shown in FIG. 2B. Each petaloid lobe 124 has a lobe bottom surface 126 for contacting a surface on which the bottle can stand. The six lobe bottom surfaces 126 are approximately coplanar with respect to one another and define a petaloid-bottle support plane. A petaloid-bottle central base surface 130 is located generally radially inwardly of the petaloid lobes 124 and above the petaloid bottle support plane by a petaloid-bottle central-base-surface clearance distance D, shown in FIG. 2B.

Each lobe bottom surface 126 contacts a petaloid-lobe contact strip 54 of the bottle seating structure 40 when the PET bottle is seated in the bottle pocket. The petaloid-lobe contact strips 54 tend to orient the PET bottle 120 in a direction normal to the petaloid-bottle lobe- bottom-surface contact plane so that the longitudinal symmetry axis of the bottle tends to extend generally parallel to the centerline of the bottle pocket. The surface of each of the six petaloid-lobe contact strips 54 facing the bottle pocket 25 defines a petaloid-bottle lobe-bottom-surface bottle-to-case load-transmission surface 53. A lower surface of each petaloid-lobe contact strip 54 is substantially coplanar with the base plane of the case 2 and defines a petaloid-bottle lobe-bottom-surface case-to-floor load-transmission surface 55.

In a multitiered stack of cases filled with PET bottles of the petaloid type, the way in which a weight load is principally borne by a case depends on whether the case is in the lowermost tier of the stack or in a higher tier. FIG. 2B illustrates how a case in one of the higher tiers bears a weight load and transmits the load to a closure 128 of a bottle 122 in a next lower tier.

The second PET bottle 122 extends below the case 2 generally coaxially with the centerline of the bottle pocket. The closure 128 of the bottle 122 is located in the case rest 60 with the top of the closure in contact with the case-to-closure load-transmission surface 63 of the case rest 60 around an annular rim on the top of the closure. Under load in a stack of cases, the petaloid-bottle central base surface 130 tends to bear against the central-base-surface bottle-to-case load-transmission surface 61 of the case rest 60. The case-to-closure load-transmission surface 63 of the case rest 60 in turn tends to bear against the annular rim area of the top of the closure 128. Thus when a case 2 loaded with PET bottles of the petaloid type is incorporated in a stack of such cases on any but the lowermost tier, a portion of the weight borne by the case tends to be substantially directly compressively transmitted from the petaloid-bottle central base surface 130 of the PET bottles 120 in the case to the annular rim areas of the tops of the closures 128 of the bottles 122 in the cases just below.

When the case 2 is incorporated in the lowermost tier of a stack of cases filled with PET bottles of the petaloid type and is resting on a warehouse pallet or other flat surface (not shown), a portion of the load carried by the bottle 120 tends to be substantially directly compressively transmitted from the six lobe bottom surfaces 126 of the bottle to the surface on which the case is resting by way of the corresponding six petaloid-lobe contact strips 54. Under load in the lowermost tier of cases, each lobe bottom surface 126 of the bottle 120 tends to bear against the petaloid-bottle lobe-bottom-surface bottle-to-case load-transmission surface 53 of the corresponding petaloid-lobe contact strip 54. The petaloid-bottle lobe-bottom-surface case-to-floor load-transmission surface 55 of the petaloid-lobe contact strip 54 in turn tends to bear against the floor on which the case is resting. Thus when a case 2 filled with PET bottles of the petaloid type is incorporated in the lowermost tier of a multitiered stack of such cases, a portion of the weight borne by the case tends to be substantially directly compressively transmitted from the lobe bottom surfaces 126 of the PET bottles in the case to the surface on which the case is resting.

Turning again to FIG. 1, a center-hole opening 62 passes through each of the two central top-sheet elements 20 of the top sheet 6. The two center-hole openings 62 are essentially circular in shape and are located respectively concentric to the center vertices of the first and second lattice squares. The center-hole openings 62 may be used by automatic case-handling equipment in a bottling plant to position the case. Each center-hole opening 62 is surrounded by a center-hole rim 64. As shown best in FIG. 4, each center-hole rim 64 projects above the top surface of the central top-sheet element 20 of the top sheet 6.

Figure 5:
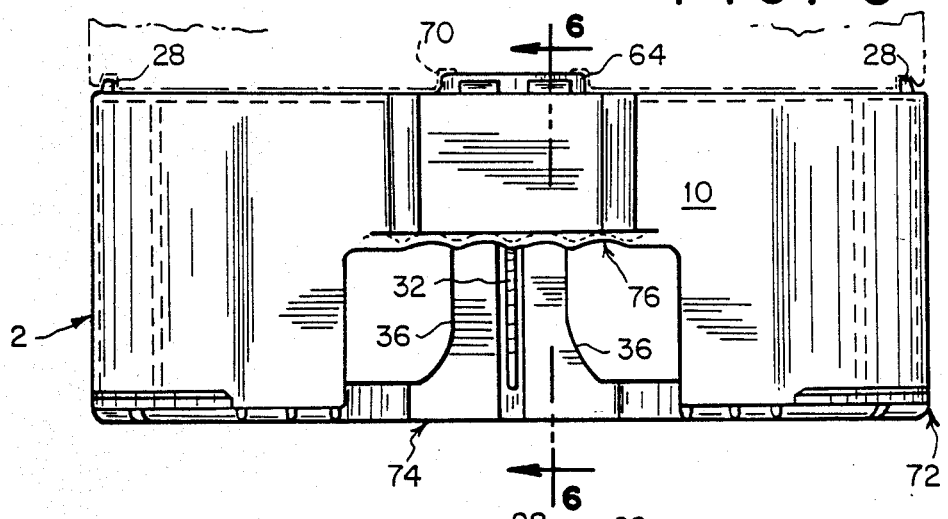
FIG. 5 is an end view of the case of FIG. 1 showing in phantom a lower portion of a second case resting on top of the case of FIG. 1.
Figure 6:
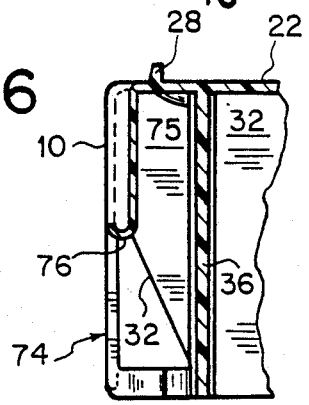
FIG. 6 is a partial cross-sectional view of the case of FIG. 1 taken along lines 6—6 of FIG. 5.

Each center-hole rim 64 is connected to a hollow center tube 66 which extends from the top sheet 6 of the case 2 to the base plane of the case. The center tube 66 generally tapers radially inwardly as it extends from the top sheet 6 of the case toward the base plane so that an interlock end 68 of the center tube 66 adjacent to the base plane of the case can fit within a center-hole rim 64 of a second case. As shown in FIGS. 3 and 4, each center tube 66 is connected the following support elements: four contour ribs 36, a crosswise partition rib 34 and the lengthwise partition rib 32. Each support element connected to a center tube 66 has an interlock notch 70 in its base edge located adjacent to the interlock end 68 of the center tube 66. The interlock notches 70 are disposed in a circular arrangement about the interlock end 68 of the center tube 66 and are shaped to receive a center-hole rim 64. As shown in FIG. 5, when two empty cases are stacked one on top of the other, the center-hole rims 64 of the lower case fit within the interlock notches 70 of the upper case to prevent the two cases from sliding with respect to another.

To further assist in interlocking two empty cases stacked one on top of the other, the thumb-grip tabs 28 on the lengthwise edge top-sheet elements 21 of the lower case engage the inside lower edges of the lengthwise wall sections 8 of the upper case, as shown in FIG. 5. A clearance gap 72 extends around a lower perimeter of the case 2 between the lower edge of the sidewall 4 and the base plane of the case. The thumb-grip tabs 28 project above the top sheet 6 a distance greater than the height of the clearance gap 72 to permit the thumb-grip tabs 28 to engage the inside lower edges of the lengthwise wall sections 8 of the upper case.

As may be seen in FIG. 5, each crosswise wall section 10 has a hand-grip opening 74 passing through it. Each hand-grip opening 74 extends upward from a lower edge of the crosswise wall section 10 so that the opening can be formed in the wall section at the time the wall section is molded. The hand-grip opening 74 opens into a finger cavity 75 which is large enough to receive the fingers of a user lifting the case. For good balance, the hand-grip openings 74 are approximately centered with respect to a lengthwise midplane which bisects the case. A finger-grip handle 76 extends along an upper edge of each hand-grip opening 74. The finger-grip handle 76 is rounded and indented so that a user can lift the case comfortably by hand. The crosswise wall section 10 is recessed in an inward direction behind the finger-grip handle 76 to permit the handle to be molded with the case and to provide a surface for the fingers of a user to bear against when lifting the case.

It is not intended to limit the present invention to the specific embodiment described above. For example, many other arrangements of support elements are possible. The handles or other features of the case could be molded separately. The case could include eight bottle pockets arranged in two parallel rows of four pockets each or some other number or arrangement of bottle pockets. It is recognized that these and other changes may be made in the case specifically described herein without departing from the scope and teaching of the instant invention, and it is intended to encompass all other embodiments, alternatives, and modifications consistent with the invention.

I claim:

1. A universal case for transporting PET bottles of a base-cup type and of a petaloid type, each type of PET bottle being generally symmetric in shape with a longitudinal symmetry axis and having a closure generally centered with respect to the symmetry axis for sealing the bottle, the PET bottle of the base-cup type having a base cup with an underside shaped to permit the bottle to stand upright on a flat horizontal surface, the underside of the base cup including a base-cup-bottle central base surface and an annular bottom surface located radially outwardly of the central base surface and in a position to contact the surface on which the bottle stands, the base-cup-bottle central base surface and the annular bottom surface being approximately coplanar with respect to one another and substantially centered with respect to the symmetry axis of the bottle, the PET bottle of a petaloid type having a plurality of petaloid lobes formed in a base of the bottle shaped to permit the bottle to stand upright on a flat horizontal surface, the lobes being disposed generally symmetrically about the symmetry axis of the bottle, undersides of the petaloid lobes being substantially coplanar with respect to one another to form lobe bottom surfaces for contacting the surface on which the bottle stands, the lobe bottom surfaces defining a petaloid bottle support plane, the base of the petaloid bottle having a petaloid-bottle central base surface located generally radially inwardly of the petaloid lobes and offset along the symmetry axis of the bottle from the petaloid bottle support plane by a petaloid-bottle central-base-surface clearance distance, the case being molded from a plastic material and comprising:

(a) an outer shell;

(b) a plurality of support elements connected to and generally disposed within the outer shell for reinforcing the shell, the outer shell and support elements being shaped to define a plurality of bottle pockets for receiving the bases of PET bottles, the number of bottle pockets defining a case-bottle-capacity number, a pocket centerline being defined to extend generally centrally through each bottle pocket;

(c) a case-bottle-capacity number of bottle seeating means for seating a bottle inserted into a bottle pocket, each bottle seating means being associated with a bottle pocket and being connected to at least one of the outer shell and the support elements and including:

(c.1) base-cup-bottle alignment means for orienting a PET bottle of the base-cup type seated in the bottle pocket so that the longitudinal symmetry axis of the bottle extends generally parallel to the pocket centerline of the bottle pocket, the base-cup-bottle alignment means having a base-cup-bottle annular-bottom-surface contact surface oriented generally normal to the pocket centerline and disposed to contact the annular bottom surface of the base cup of the bottle to orient the bottle, the base-cup-bottle annular-bottom-surface contact surface defining a base-cup-bottle annular-bottom-surface contact plane; and (c.2) petaloid-bottle alignment means for orienting a PET bottle of the petaloid type seated in the bottle pocket so that the longitudinal symmetry axis of the bottle extends generally parallel to the pocket centerline of the bottle pocket, the petaloid-bottle alignment means having a plurality of petaloid-bottle lobe-bottom-surface contact surfaces, the petaloid-bottle lobe-bottom-surface contact surfaces being substantially coplanar with one another to define a petaloid-bottle lobe-bottom-surface contact plane, the petaloid-bottle lobe-bottom-surface contact plane being oriented generally normal to the pocket centerline, the petaloid-bottle lobe-bottom-surface contact surfaces being disposed generally symmetrically about the pocket centerline at locations to register with and contact the lobe bottom surfaces of the bottle to orient the bottle, the petaloid-bottle lobe-bottom-surface contact plane being below the base-cup-bottle annular-bottom-surface contact plane when the case is in a horizontal rest position and spaced apart from the base-cup-bottle annular-bottom-surface contact plane by a distance approximately equal to the petaloid-bottle central-base-surface clearance distance;

(d) a case-bottle-capacity number of case rests, each case rest being associated with a bottle pocket, the case rest being connected to the bottle seating means associated with the bottle pocket, the case rest being generally symmetrically located with respect to the pocket centerline, each case rest having a central-base-surface bottle-to-case load-transmission surface and a case-to-closure load-transmission surface, the central-base-surface bottle-to-case load-transmission surface facing the bottle pocket and being located in approximately the base-cup-bottle annular-bottom-surface contact plane in a position to contact the central base surface of a PET bottle of the base-cup type or the petaloid type seated in the bottle pocket, the case-to-closure load-transmission surface of the case rest being generally spaced apart from the central-base-surface bottle-to-case load-transmission surface in a direction generally parallel to the pocket centerline directed away from the bottle pocket, the case rest being configured to locate a closure of a bottle oriented generally coaxially with the pocket centerline such that a top surface of the closure contacts the case-to-closure load-transmission surface, so that cases of bottles can be stacked one on top of the other with the case rests of an upper case resting on the closures of the bottles of a lower case with the case-to-closure load-transmission surfaces of the case rests contacting the tops of the closures and with the central base surfaces of PET bottles of either the base-cup type or the petaloid type in the pockets of the upper case contacting the central-base-surface bottle-to-case load-transmission surfaces of the case rests so that weight tends to be transmitted from a central base surface of a bottle in an upper case substantially directly compressively through a case rest to the top of a closure of a bottle in a lower case.

2. The case according to claim 1 in which the base-cup bottle alignment means has a base-cup-bottle annular-bottom-surface case-to-floor load-transmission surface located substantially in a base plane of the case, the base-cup-bottle annular-bottom-surface case-to-floor load-transmission surface being generally spaced apart from the base-cup-bottle annular-bottom-surface contact surface of the base-cup-bottle alignment means in a direction generally parallel to the pocket centerline directed away from the bottle pocket, so that when the case is filled with PET bottles of the base-cup type and is resting on a horizontal flat surface weight tends to be transmitted from the annular bottom surfaces of the base cups of the bottles in the case substantially directly compressively through the base-cup bottle alignment means to the surface on which the case is resting; and in which the petaloid bottle alignment means has a plurality of petaloid-bottle lobe-bottom-surface case-to-floor load-transmission surfaces equal in number to the number of petaloid-bottle lobe-bottom-surface contact surfaces and located substantially in the base plane of the case, each petaloid-bottle lobe-bottom-surface case-to-floor load-transmission surface being spaced apart from a corresponding petaloid-bottle lobe-bottom-surface contact surface in a direction generally parallel to the pocket centerline directed away from the bottle pocket, so that when the case is filled with PET bottles of the petaloid type and is resting on a horizontal flat surface weight tends to be transmitted from the lobe bottom surfaces of the bottles in the case substantially directly compressively through the petaloid-bottle alignment means to the surface on which the case is resting.

3. The case according to claim 2 in which the petaloid bottle alignment means has six petaloid-bottle lobe-bottom-surface contact surfaces and six petaloid-bottle lobe-bottom-surface case-to-floor load-transmission surfaces, the six petaloid-bottle lobe-bottom-surface contact surfaces being disposed symmetrically at substantially equiangular intervals about the pocket centerline.

4. The case according to claim 3 in which the case-to-closure load-transmission surface of each case rest has a generally flared configuration.

5. The case according to claim 4 in which each case rest has a pocket center opening passing through it, the pocket center opening being generally circular in shape and substantially centered with respect to the pocket centerline with a diameter less than an outside diameter of the closure of a PET bottle, the pocket center opening serving to protect printed matter on central portions of the tops of closures of PET bottles on which the case is resting from abrasion.

6. The case according to claim 4 in which each base-cup-bottle alignment means includes:

(c.1.i) a base-cup contact ring, the base cup contact ring having an ouside diameter approximately equal to an outside diameter of the annular bottom surface of a base cup of a PET bottle of the base-cup type; and (c.1.ii) six base-cup contact spokes disposed at substantially equiangular intervals about the pocket centerline, each base-cup contact spoke extending in a radial direction and being connected at a radially outer end to the base-cup contact ring and at a radially inner end to the case rest, surfaces of the base-cup contact spokes and the base-cup contact ring facing the bottle pocket lying substantially in a plane substantially normal to the pocket centerline and constituting the base-cup-bottle annular-bottom-surface contact surface, the base-cup contact ring and the base-cup contact spokes having edges opposing the base-cup-bottle annular-bottom-surface contact surface and located substantially in the base plane of the case to constitute the base-cup-bottle annular-bottom-surface case-to-floor load-transmission surface of the base-cup-bottle alignment means.

7. The case according to claim 6 in which each petaloid-bottle alignment means includes six lobe-bottom-surface contact strips, each lobe-bottom-surface contact strip being located between and connected to an adjacent pair of base-cup contact spokes, a surface of the petaloid-bottle lobe-bottom-surface contact strip facing the bottle pocket constituting a petaloid-bottle lobe-bottom-surface contact surface of the petaloid-bottle alignment means, an opposing side of the petaloid-bottle lobe-bottom-surface contact strip being located substantially in the base plane of the case and constituting a petaloid-bottle lobe-bottom-surface case-to-floor load-transmission surface.

8. The case according to claim 7 in which each petaloid-bottle lobe-bottom-surface contact strip is connected to the pair of base-cup contact spokes between which it is located by a pair of inclined lobe-locating sidewalls, each inclined lobe-locating sidewall being connected to an edge of a petaloid-bottle lobe-bottom-surface contact strip located substantially in the petaloid-bottle lobe-bottom-surface contact plane and extending to the base-cup-bottle annular-bottom-surface contact plane in a direction which is inclined with respect to the pocket centerline, the inclined lobe-locating sidewalls being configured to tend to guide and locate the bottoms of lobes of a PET bottle of the petaloid type inserted in the bottle pocket into registry with the petaloid-bottle lobe-bottom surface contact surfaces.

9. The case according to claim 8 in which each bottle seating means further includes a bottle-side-wall gripper adapted to grip the side walls of bottles seated in the bottle pocket to assist in orienting the bottles.

* * * * *